US006695307B2

(12) United States Patent
Kanagawa

(10) Patent No.: US 6,695,307 B2
(45) Date of Patent: Feb. 24, 2004

(54) BILL HANDLING MACHINE

(75) Inventor: Takeshi Kanagawa, Owariasahi (JP)

(73) Assignee: Hitachi, Ltd., Tokyo (JP)

( * ) Notice: Subject to any disclaimer, the term of this patent is extended or adjusted under 35 U.S.C. 154(b) by 23 days.

(21) Appl. No.: 09/988,800

(22) Filed: Nov. 20, 2001

(65) Prior Publication Data

US 2002/0074709 A1 Jun. 20, 2002

(30) Foreign Application Priority Data

Nov. 24, 2000 (JP) ..... 2000-358077

(51) Int. Cl.[7] ..... B65H 31/06

(52) U.S. Cl. ..... 271/207; 271/164; 271/306; 271/198; 902/9

(58) Field of Search ..... 271/9.01, 279, 271/160, 164, 207, 306, 198; 902/9, 15, 17; 109/45; 232/43.2

(56) References Cited

U.S. PATENT DOCUMENTS 4,549,661 A * 10/1985 Morishita et al. ..... 209/534
5,326,092 A * 7/1994 Ando ..... 271/272
6,123,327 A * 9/2000 Holland-Letz et al. ..... 271/4.09

FOREIGN PATENT DOCUMENTS

JP 2000-172946 6/2000

* cited by examiner

*Primary Examiner*—Donald P. Walsh
*Assistant Examiner*—Kaitlin Joerger
(74) *Attorney, Agent, or Firm*—McDermott, Will & Emery

(57) ABSTRACT

A bill handling machine includes a first unit having a depositing port for depositing bills; a second unit having a depositing cassette for holding deposited bills; and a bill transfer mechanism for transferring bills from the depositing port to a depositing cassette. At least one of the first and second units is installable and removable, and the bill transfer mechanism is provided with a first transfer mechanism provided in the installable and removable unit and a connecting transfer mechanism connected to the first transfer mechanism and enabled to control the connection with the transfer mechanism in the installable and removable unit in conjunction with the removal/installation of the unit.

21 Claims, 8 Drawing Sheets

BILL HANDLING MACHINE

BACKGROUND OF THE INVENTION

The present invention relates to a bill handling machine that handles various bills, more particularly a bill handling machine that can protect bills and components therein from damage. Remaining bills, as well as guides that are structural components of a transfer path connecting means of the machine are protected from damages when a unit that includes one of divided transfer means is pulled out from the machine.

In any of conventional bill handling machines, for example, in an automatic cash handling machine, bills have had to be stacked in such a reinforced structure cabinet as a safe so as to be protected from robberies and other crimes. As one of such general crime-preventive measure, all of the bill handling mechanisms including the bill stackers, as well as depositing and withdrawing processors of bills are installed in a safe, so that customers are required to deposit and withdraw bills through an aperture of the safe.

On the other hand, there is also another means that divides a bill handling machine into a bill processor block and a bill stacker block so that the bill stacker block is installed in a protective cabinet. For example, the JP-A-2000-172946 discloses an example that a bill depositing/withdrawing machine is divided into upper and lower units so that the lower unit is installed in a cassette cabinet so as to improve the security of the bill stackers therein.

SUMMARY OF THE INVENTION

However, in the case where a bill handling machine is provided with transfer path connecting means enabled to dispose divided bill handling mechanisms inside and outside a protective cabinet and connect the divided transfer means to each other, bills remain around the transfer path connecting means sometimes. In such a case, the remaining bills or a bill guide, which is a part of the transfer path connecting means, is often damaged when the unit that includes one of the divided bill transfer means is pulled out from the machine so as to remove any jammed bill.

Under such circumstances, it is an object of the present invention to provide a bill handling machine that can protect bills and/or the bill guides that are structural components of the transfer path connecting means from damages when the unit that includes one of the divided transfer means is pulled out from the machine.

In order to attain the above object, the bill handling machine of the present invention includes bill transfer means that is divided into two units so that one of the divided units is provided inside a protective cabinet (safe cabinet) and the other is provided outside the protective cabinet; and transfer path connecting means provided between those divided bill transfer means, so that the unit that includes one of the bill transfer means is pulled out vertically to the direction in which bills are transferred. The transfer path connecting means is provided with a pair of guides that can be opened and closed respectively. And, the unit to be pulled out is provided with a first projection and the other guide is provided with a second projection, which is located at a position where one guide comes in contact with the first projection of the other guide that is pressed so as to open by a spring or the like. When the unit is pulled out/inserted from/into the machine, the first projection limits the position of the second projection, thereby allowing the opening/closing of the guide to be controlled.

Because the guide is pressed by a spring or the like so as to open and the guide is limited in position such way, opening/closing of the guide is controlled. The pair of guides, when connected to each other via a gear, can also be controlled so as to open/close together.

In addition, according to whether the unit is pulled out to the front or the rear of the machine, it is possible to change the position where the first projection is to be provided and one of the second projections provided at the pair of guides in the transfer path connecting means and used at that time. Consequently, the pair of guides can be opened/closed properly.

Because the machine is composed in such way, it is possible to prevent bills remaining around the transfer path connecting means and the opening/closing guides from damages.

DETAILED DESCRIPTION OF PREFERRED EMBODIMENTS

Hereunder, a preferred embodiment of the present invention will be described with reference to the accompanying drawings.

Figure 1:
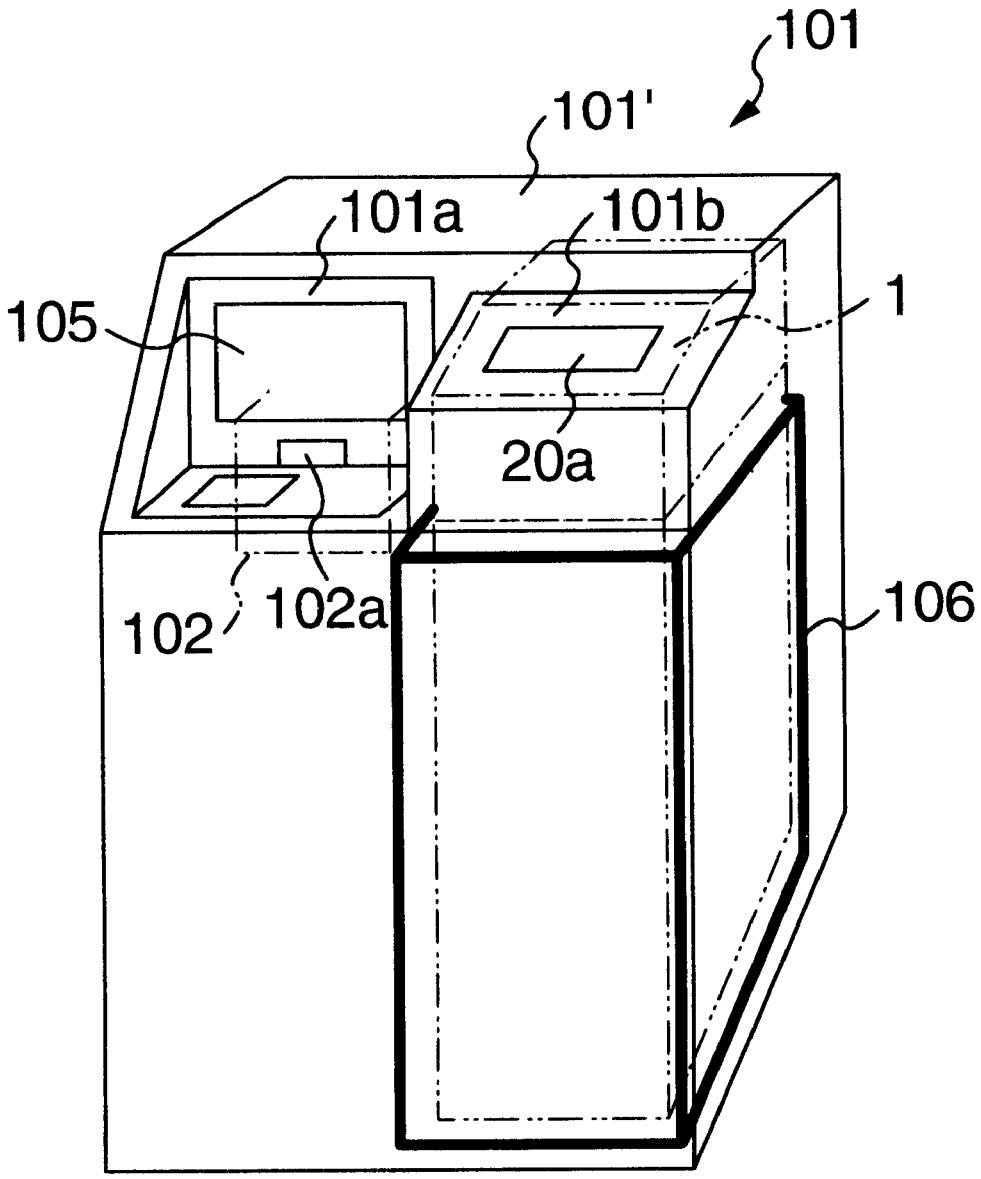
FIG. 1 is a perspective view of an appearance of an embodiment of an automatic cash handling machine to which the present invention is applied.

FIG. 1 is a perspective view of an appearance of an embodiment of an automatic cash handling machine according to the present invention.

An automatic cash handling machine 101 is housed in a machine cabinet 101'. In a left side inside the case 101' are provided a card/detail slip processing mechanism 102 in communication with a card slot 102*a* located at a top front panel 101*a* and enabled to process customer cards and print out transaction detail slips, then discharge the slips; and a customer panel 105 enabled to display and enter contents of each transaction. In the right side inside the machine is provided a bill depositing/withdrawing mechanism 1 that processes bills. A bill slot 20*a* is provided at the top-inclined front board 101*b*.

The lower bill stacker of the bill depositing/withdrawing mechanism 1 is housed in a safe cabinet 106 composed of an iron plate of a few tens of millimeters in thickness separately from the machine cabinet 101'. Although the machine cabinet 101' is strong in structure, the safe cabinet 106 is structured more strongly so as to improve the security. This automatic cash handling machine 101 enables users to deposit, withdraw, and transfer money with use of cards, bills, and detail slips.

Figure 2:
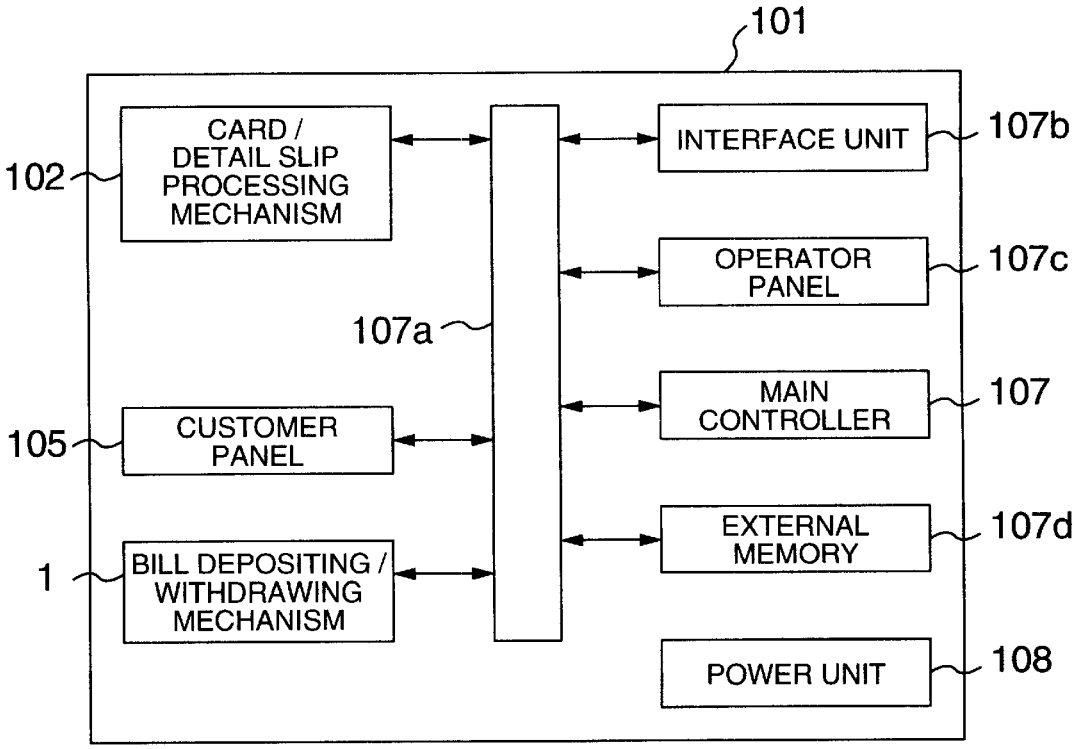
FIG. 2 is a block diagram of an embodiment of a control system of a bill depositing/withdrawing mechanism.

FIG. 2 shows a block diagram of a control relation of an embodiment of the automatic cash handling machine 101. As described above, the card/detail slip processing mechanism 102, the bill depositing/withdrawing mechanism 1, and the customer panel 105 housed in the automatic cash handling machine 101 are connected to a main controller 107 via a bus 107*a* so as to enable the customers to execute necessary operations under the control of the controller 107.

In addition to the above items, the controller 107 is also connected to an interface unit 107*b*, an operator panel 107*c*, and an external memory 107*d* via the bus 107*a* so as to send/receive necessary data. Reference number 108 in FIG. 2 denotes a power unit that supplies a power to each of the components of the machine 101.

Figure 3:
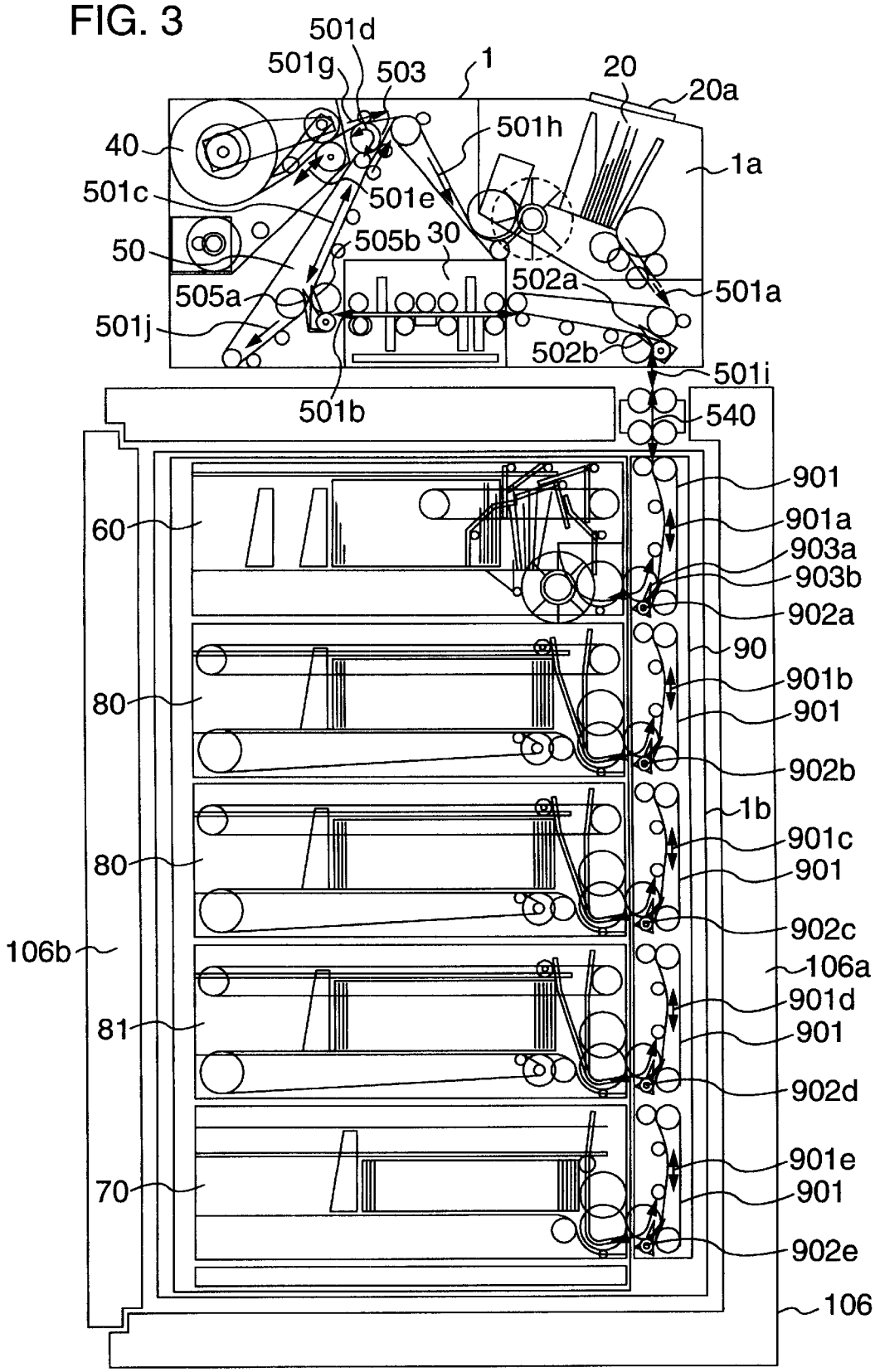
FIG. 3 is a side view of the structure according to an embodiment of the bill depositing/withdrawing mechanism in accordance with the present invention.

FIG. 3 is a side view showing a configuration of an embodiment of the bill depositing/withdrawing mechanism 1 in FIG. 1. The bill depositing/withdrawing mechanism 1 is composed of a depositing/withdrawing port 20 that enables users to deposit/withdraw bills; a bill checker 30 for checking bills; a temporary stacker 40 for holding deposited bills until the transaction is established; a depositing cassette 60 for holding bills after the depositing transaction is established; a withdrawing cassette 70 for holding bills to be withdrawn; two recycling cassettes 80 used for both depositing and withdrawing respectively; a loading/collecting cassette 81 for holding bills to be replenished in the recycling cassette 80 and collected from the two recycling saves; a bill transfer path 50 for transferring bills to the depositing/withdrawing port 20, the temporary stacker 40, the depositing cassette 60, the withdrawing cassette 70, the recycling cassettes 80, and the loading/collecting cassette 81 respectively via the bill checker 30; and a controller (not shown).

In the above example, while the bill depositing/withdrawing port 20 is composed so as to be used as both a depositing port and a withdrawing port, it is not necessarily composed that way. The depositing port for transferring bills deposited by customers into the machine may be provided separately from the withdrawing port for holding bills to be withdrawn by customers.

Figure 4:
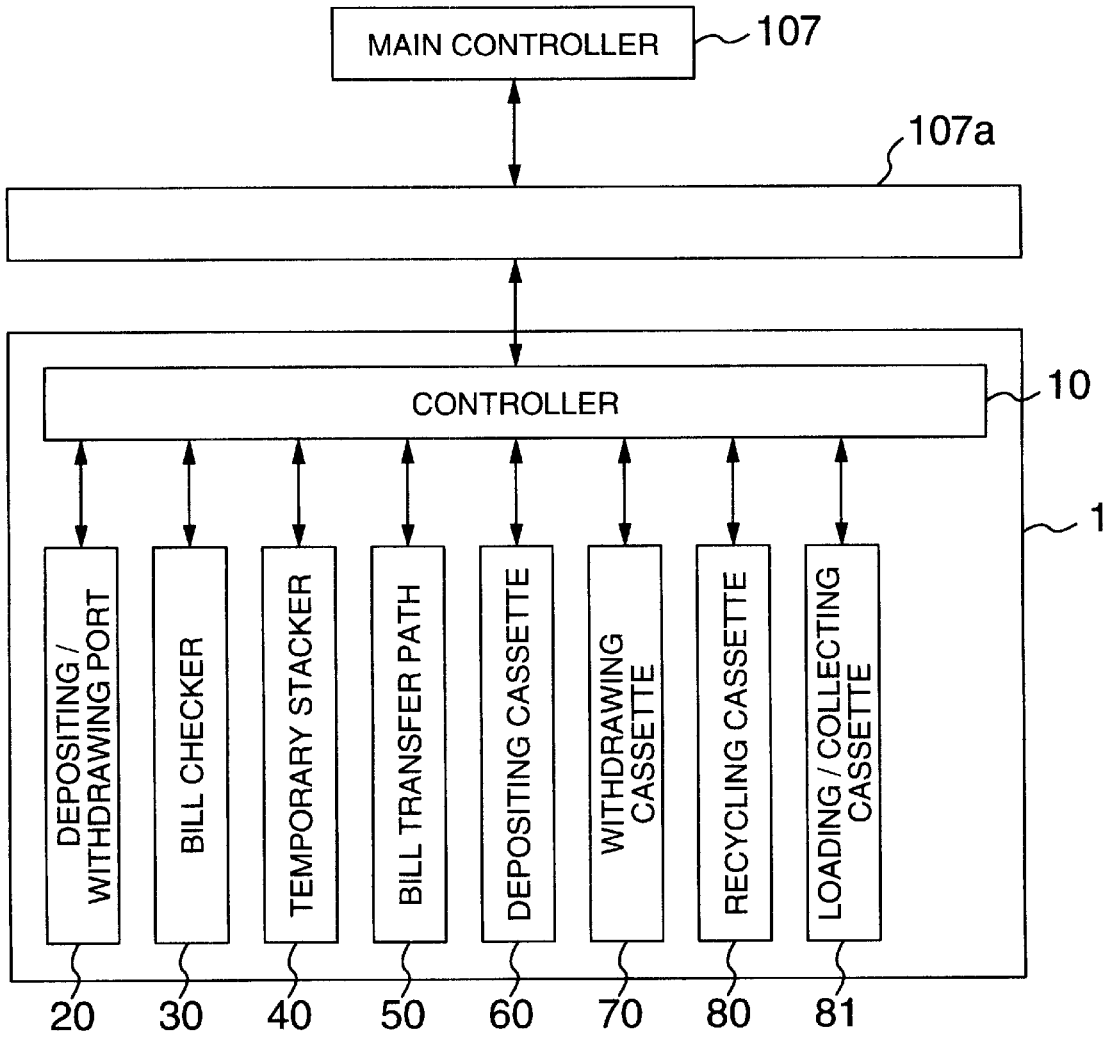
FIG. 4 is a block diagram for explaining a control relation of an embodiment of the bill depositing/withdrawing mechanism.

FIG. 4 is a controlling block diagram for explaining a control relation of an embodiment of the bill depositing/withdrawing mechanism 1. As shown in FIG. 4, the controller 10 of the bill depositing/withdrawing mechanism 1 is connected to the main controller 107 of the automatic cash handling machine 101 via the bus 107*a*, so that the controller 10 controls the bill depositing/withdrawing mechanism 1 according to the instruction from the main controller 107 and the detected state of the bill depositing/withdrawing mechanism 1. The controller 10 also sends the state of the bill depositing/withdrawing mechanism 1 to the main controller 107 via the bus 107*a* as needed. In addition, in the bill depositing/withdrawing mechanism 1, the controller 10 is connected to the driving motor, the electromagnetic solenoid, and the sensor (not shown) of each unit (depositing/withdrawing port 20; bill checker 30; temporary stacker 40; bill transfer path 50; depositing cassette 60; withdrawing cassette 70; recycling cassettes 80; and loading/collecting cassette 81), so that the controller 10 controls driving of an actuator for each transaction while monitoring the state of the unit via the sensor.

The bill depositing/withdrawing mechanism 1, as shown in FIG. 3, is composed of an upper bill mechanism 1*a* and a lower bill mechanism 1*b*. The upper bill mechanism 1*a* is composed of a depositing/withdrawing port 20; a bill checker 30; a temporary stacker 40; and a bill transfer path 50. The lower bill mechanism 1*b* is composed of a depositing cassette 60; a withdrawing cassette 70; two recycling cassettes 80; a loading/collecting cassette 81; and a transfer path 90 disposed in front of each bill stacker.

Furthermore, the lower bill mechanism 1*b* is housed in a cassette cabinet (protective cabinet) 106 made of an iron plate having a thickness of about 50 mm. The (upper) transfer path of the upper bill mechanism 1*a* and the (lower) transfer path of the lower bill mechanism 1*b* are connected to each other via a connecting transfer path (transfer path connecting means) 540, so that bills are transferred between the upper and lower bill mechanisms 1*a* and 1*b* via the connecting transfer path 540.

More concretely, the connecting transfer path 540 is built in the top iron plate of the cassette cabinet (protective cabinet) 106 in which the lower bill mechanism 1*b* is housed at a place where the transfer path 501*i* of the upper bill mechanism 1*a* is connected to the transfer path 901*a* of the lower bill mechanism 1*b* as shown in FIG. 3. The slit opened at the top iron plate is sized enough to pass bills and equally to the width of the transfer roller attached so as to pinch and transfer bills passed through the slit.

The driving source (motor) of the transfer path may be provided at the (upper) transfer path of the upper bill mechanism 1*a* and at the (lower) transfer path of the lower bill mechanism 1*b* separately. However, it is also possible to use a single driving source for transmitting a driving power to each of the transfer paths with use of a gear provided in the transfer paths 501*i*, 540, and 901*a* respectively.

The bill transfer path 50 that passes through both sides of the bill checker 30 is connected to the depositing/withdrawing port 20; the temporary stacker 40; the depositing cassette 60; the withdrawing cassette 70; the recycling cassettes 80; and the loading/collecting cassette 81 via the transfer paths denoted by arrows 501*a* to 501*h* and arrows 901*a* to 901*e*. Each one-way arrow denotes a one-way bill transfer path for transferring bills only in that direction and each two-way arrow denotes a two-way transfer path switchable in any of the two directions in which bills are transferred in each transaction. In this embodiment, all the transfer paths are two-way paths, since the bill handling machine is used for depositing and withdrawing bills. When the bill handling machine is used only for withdrawing bills, however, those transfer paths may be one-way paths.

Furthermore, at each branch of the bill transfer path 50 are provided selector gates 502, 503 and 505, as well as five other selector gates 902*a* to 902*e*. Each gate has two positions, such as represented by the positions 502*a*. 502*b* and 505*a* and 505*b* of gates 502 and 505, or as represented by the positions 903*a* and 903*b* of the exemplary selector gate 902*a*. Each gate is positioned at a or b at each processing so as to select a bill transfer direction. With such a configuration employed for the bill depositing/withdrawing mechanism 1, each user is enabled to deposit/withdraw bills while the operator is enabled to load/collect bills.

At first, a depositing process for the automatic cash handling machine will be described. When a user deposits bills through the depositing/withdrawing port 20, the bills are separated one by one and each bill is checked for both type and authenticity in the bill checker 30. Each bill checked by the bill checker 30 is transferred through the selector gate 503 positioned appropriately to the bill type and held in the temporary stacker 40.

A bill, when it is rejected by the bill checker 30 because of an error (abnormally eccentric, abnormal spacing (bills are stacked on top of one another)), is not transferred into the temporary stacker 40, but it is returned to the depositing/withdrawing port 20 through the selector gate 503 positioned in accordance with the rejection. The user is thus requested to take the rejected bill from the port 20.

When the depositing processing is established, the bills held in the temporary stacker 40 are transferred in the reverse direction in the reverse order they are held there to pass the bill checker 30. Each bill, which passes the bill checker 30, goes through the selector gate 502 positioned so as to select the direction 502*a* into the specified safe through one of the 903 gates 902*a*–902*e* of any of the depositing cassette 60, the recycling cassettes 80, and the rejection cassette 90. For example, the selector gate 902*a* is positioned so as to select the direction 903*b* at this time instead of the flow-through path 903*a*. This completes the depositing processing.

Next, a withdrawing processing will be described. A withdrawing processing begins first with unloading the predetermined number of bills from the safe of each bill type provided in the withdrawing cassette 70 and the recycle cassettes 80 respectively. The bills are then transferred to the bill checker 30 and checked for bill type respectively. Then, the selector gate 503 is positioned so as to transfer the checked bills towards the depositing/withdrawing port. The bills, when passing the bill checker 30, are held at the depositing/withdrawing port 20 so that the user can take them by opening the upper shutter of the slot 20*a*. When the user picks up the bills from the port 20, the withdrawing processing is terminated.

Next, processings for loading and collecting bills in/from the recycling cassettes 80 will be described. Loading and collecting of bills are done by transferring bills among the loading/collecting cassette 81, the temporary stacker 40, and the recycle cassettes 80.

At first, loading of bills will be done as follows. Bills are set in the loading/collecting cassette 81 at a time, then they are held in the recycle cassettes 80 automatically in the machine. A collecting processing is done so as to collect the predetermined number of bills from the recycle cassettes 80, then load them in the loading/collecting cassette 81 automatically, for example, when the recycle cassettes 80 become full. Collecting of bills is thus done in the reverse order of the loading of bills.

This completes the description of the basic processings of the bill depositing/withdrawing mechanism 1. This bill depositing/withdrawing mechanism 1 is installed in the right side in the automatic cash handling machine 101 as shown in FIG. 1.

Next, a configuration of the bill depositing/withdrawing mechanism 1 will be described with reference to FIGS. 5A to SC with respect to the controllability from the viewpoint of the operator. The automatic cash handling machine 101 in this embodiment can take any of the configuration for doing maintenance from the front side of the machine 101 (front side operation type) and the configuration for doing maintenance from the rear side (rear side operation type). In any configuration, the upper and lower bill mechanisms 1*a* and 1*b* can be installed in and removed from the machine 101 as needed with use of an employed sliding mechanism such as a sliding rail or the like. While both of the upper and lower bill mechanisms 1*a* and 1*b* are installed and removed in such a way in this embodiment, this embodiment is not limited to this, and the present invention also enables just one of the mechanisms 1*a* and 1*b* to be removed.

Figure 5A:
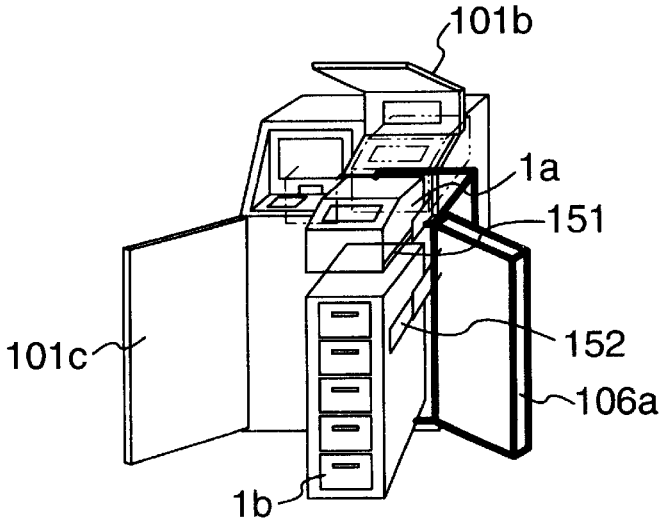
FIGS. 5A to 5C are illustrations of structures concerning the operator's controllability of the bill depositing/withdrawing mechanism.

When a maintenance work is done for the upper bill mechanism 1*a* from the front side of the machine 101 (front side operation type), a lock mechanism (not shown) is reset from the front side of the machine 101, then the surface-inclined top panel 101*b* is raised so as to open as shown in FIG. 5A, then the upper bill mechanism 1*a* is pulled out from the machine 101 towards the front side along the sliding rail mechanism 151. Thus, the maintenance work is enabled.

A maintenance work for the lower bill mechanism 1*b* can be done as follows. The lock mechanism (not shown) is reset so as to open the front door 101*c* of the machine 101. Then, the front door 106*a* of the cassette cabinet 106 is opened by unlocking the lock (not shown). After this, the lower bill mechanism 1*b* is pulled out to this side from the bill depositing/withdrawing mechanism 1 along the sliding rail mechanism 152. Now, the maintenance work can be done.

Figure 5B:
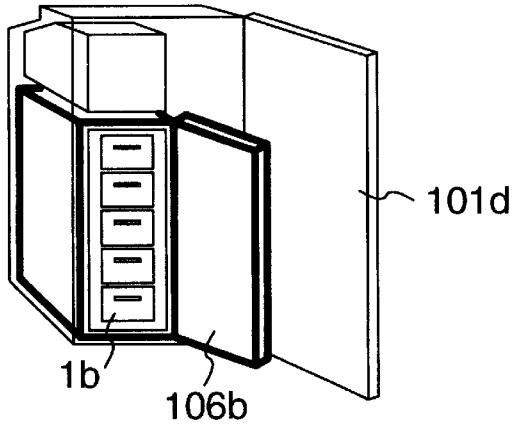
Figure 5C:
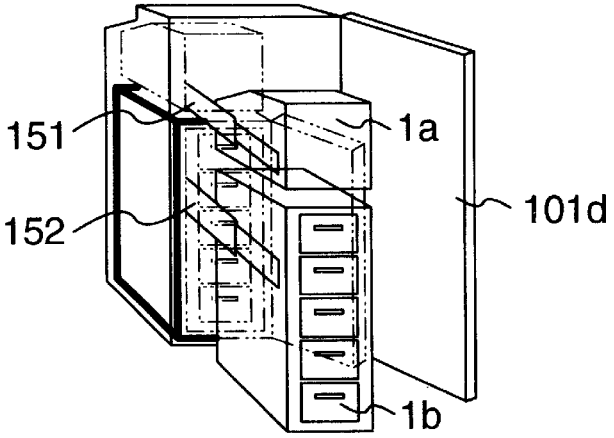

When a maintenance work is done from the rear side of the machine 101 (rear side operation type), the lock mechanism (not shown) is reset from the rear side as shown in FIG. 5B, then the rear door 101*d* of the machine 101 is opened. After this, the upper bill mechanism 1*a* is pulled out from the bill depositing/withdrawing mechanism 1 along the sliding rail mechanism 151 as shown in FIG. 5C. Now, the maintenance work can be done.

Furthermore, the lock (not shown) of the rear door 106*b* of the cassette cabinet 106 is unlocked so as to open it, then the lower bill mechanism 1*b* is pulled out from the depositing/withdrawing mechanism 1 along the sliding rail mechanism 152. Now, the maintenance work can be done.

As described above, the bill depositing/withdrawing mechanism 1 in this embodiment is enabled for any of the front side operation configuration that enables maintenance from the front side and the rear side operation configuration that enables maintenance from the rear side of the machine 101.

Figure 6A:
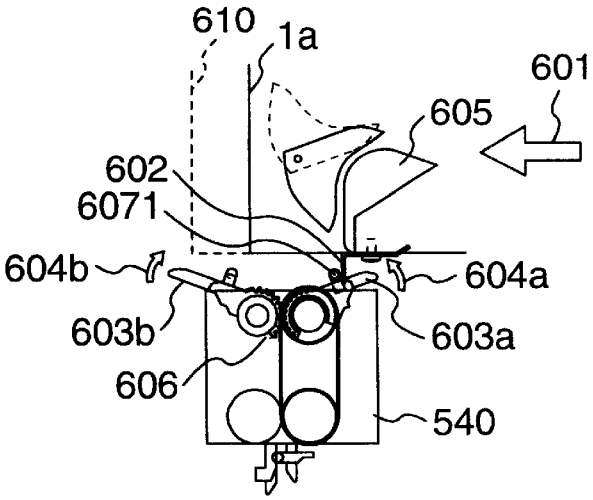
FIGS. 6A to 6F are views of concrete embodiments for a connecting transfer path (transfer path connecting means) according to the present invention.
Figure 6D:
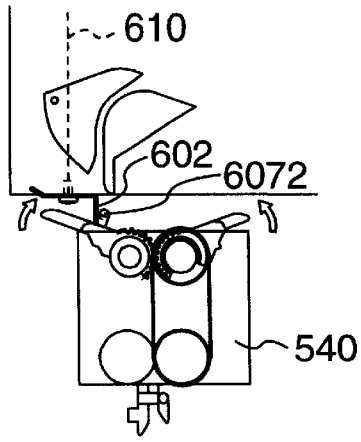
Figure 6B:
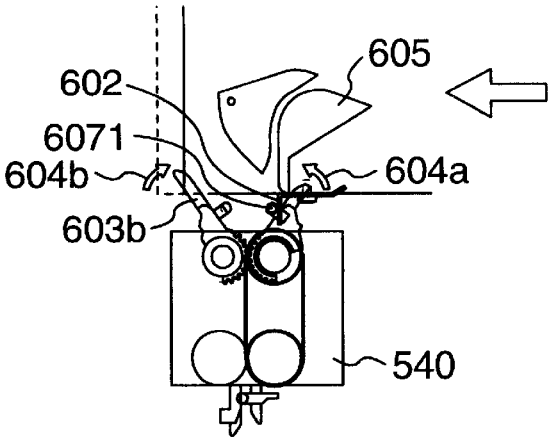
Figure 6E:
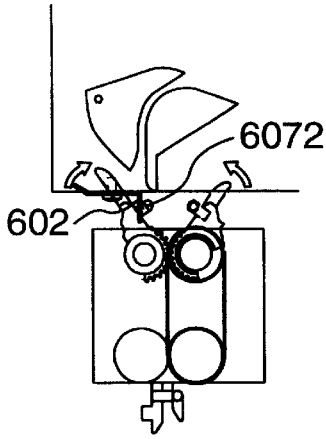
Figure 6C:
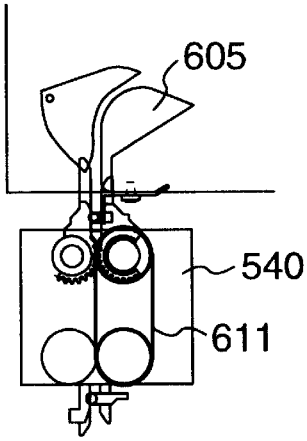

FIGS. 6A to 6F show a concrete example of the connecting transfer path (transfer path connecting means) 540 in this embodiment with respect to an operation for returning the removed upper bill mechanism 1*a* to the reference position. FIG. 6A through FIG. 6C show how the upper bill mechanism 1*a*, which has been pulled out for a maintenance work, is slid in the direction of the arrow 601 and returned to the reference position 610 from the rear side of the machine 101.

Figure 8:
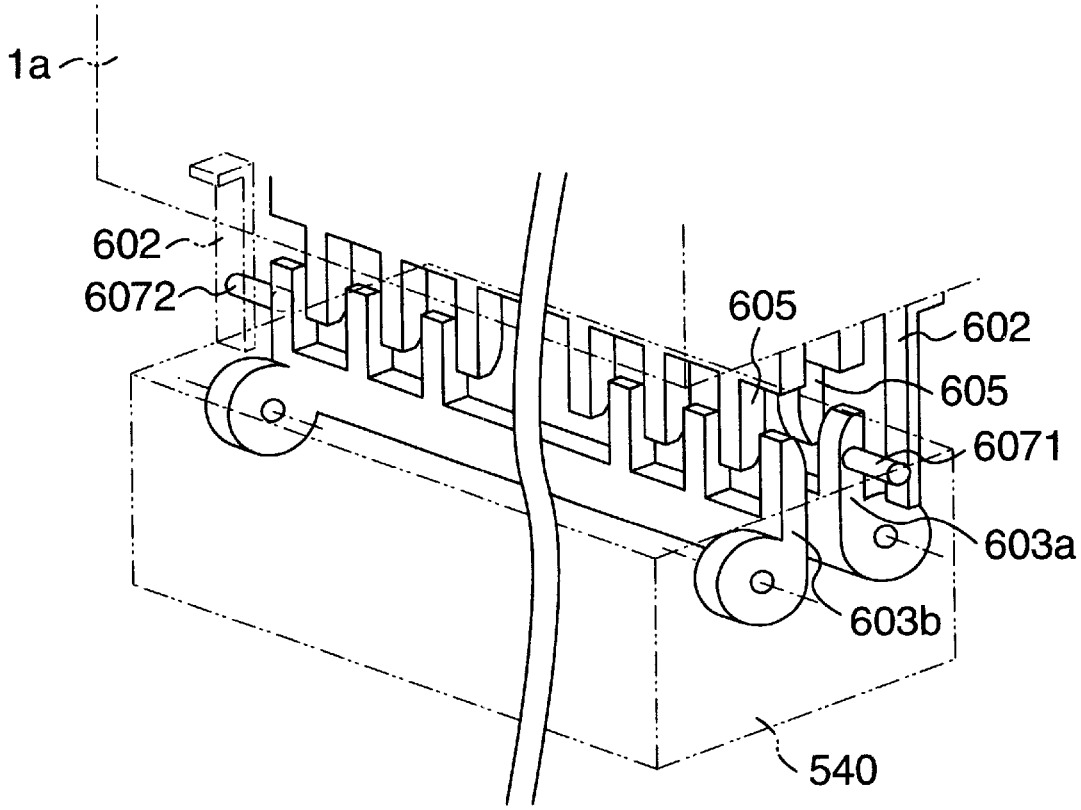
FIG. 8 is a schematic view of a structure of a connecting portion where the connecting transfer path (transfer path connecting means) is connected to an upper bill transfer mechanism.

Here, a description will be made first for the structure of the connecting portion between the connecting transfer path (transfer path connecting means) 540 and the upper bill mechanism 1*a* with reference to FIG. 8. As shown in FIG. 8, an end portion of each transfer guide 605 is formed like a comb at the connecting portion of the upper bill mechanism 1*a*. The transfer guides 605 are provided at both sides of the transfer path in the upper bill mechanism 1*a*. And, a first projection 602 is fixed to the end portion of each transfer guide 605 with screws, etc. The fixing position of the first projection 602 is varied according to whether the upper bill mechanism 1*a* is pulled out towards the front side or rear side of the machine 101. When the mechanism 1*a* is pulled out towards the front side, the first projection 602 is fixed to the position denoted by a solid line in FIG. 8. When the mechanism 1*a* is pulled out towards the rear side, the first projection is fixed to the position denoted by a dotted line in FIG. 8.

The connecting transfer path (transfer path connecting means) 540 is provided with comb-like opening/closing guides A 603*a* and B 603*b* to be engaged with the right and left comb-like transfer guides 605 respectively. The opening/closing guides A 603*a* and B 603*b* are enabled to rotate around an axis respectively. Usually, each of the guides A 603*a* and B 603*b* is pressed to open by such an elastic mechanism as a spring.

The guide A 603*a* is provided with a second projection 6071 at a place where the guide A 603*a* comes in contact with the first projection 602. The guide B 603*b* is provided with a second projection 6072 denoted by a dotted line in FIG. 8 at a place where the guide B 603*b* comes in contact with the first projection 602 whose position is changed to a position denoted by a dotted line as described above so as to enable the upper bill mechanism 1*a* to be inserted from the other direction (for example, from the front side of the machine 101).

When the upper bill mechanism 1*a* is inserted into the machine 101 from one direction, the first projection 602 presses the second projection 6071 to come in contact with a guide. For example, when the upper bill mechanism 1*a* is installed from the rear side of the machine 101, the first projection 602 located this side in FIG. 8 is pressed against the transfer path by the second projection 6071 provided at the opening/closing guide 603*a* located at the rear side of the machine 101, thereby the projection 602 rotates counter-clockwise around the axis. On the contrary, when the mechanism 1*a* is installed from the front side of the machine 101, the second projection 6072 provided at the opening/closing guide 603*b* located at the front side of the machine 101 is pressed against the transfer path by the first projection 602 located at the other side in FIG. 8, thereby the projection 6072 rotates clockwise around the axis. When the upper bill mechanism 1*a* is slid, therefore, the opening/closing guides 603*a* and 603*b*, against the spring elastic powers, come to be engaged with the transfer guides 605 of the upper bill mechanism.

Although not shown in FIG. 8, the guides A 603*a* and B 603*b* are connected to each other via a gear (see 606 in FIGS. 6A to 6F) so as to open together in this embodiment. Consequently, due to this configuration, when one opening/closing guide (603*a* or 603*b*) is pressed, two opening/closing guides 603*a* and 603*b* can be engaged together with the transfer guides 605 of the upper bill mechanism.

Next, a description will be made for an operation for returning the pulled-out upper bill mechanism 1*a* to the reference position with reference to FIGS. 6A to 6F. FIG. 7A through FIG. 7C are expanded views of the first projection 602, the second projection 6071, the opening/closing guide A 603*a*, and the opening/closing guide B 603*b* shown in FIG. 6A through FIG. 6C so as to make it easier to understand the above operation.

In FIGS. 6A to 6F or 7A to 7C, the opening/closing guides A 603*a* and B 603*b* are different from each other in length. This is because the transfer guides 605 of the upper bill mechanism 1*a*, to be engaged with them respectively, are also different from each other in length. Concretely, the transfer guide 605 to be engaged with the guide B 603*b* is provided with the function of a selector gate for selecting a direction of the two-way transfer described above. The transfer guide 605 thus rotates to a position denoted by a dotted line in FIG. 6A according to the selected transfer direction. And, one of the transfer guides 605 is formed shorter than the other so as not to come in contact with other peripheral members when the transfer guide 605 rotates.

FIG. 6A and FIG. 7A show how the upper bill mechanism 1*a*, which is pulled out to the rear side of the machine 101, is pushed into the machine 101 (rear side operation type). In this case, the first projection 602 of the upper bill mechanism 1*a* presses the second projection 6071 of the opening/closing guide A 603*a*, thereby the opening/closing guide A 603*a* is rotated in the direction of the arrow 604*a* (see FIG. 6B/FIG. 7B). As described above, the opening/closing guide A 603*a* is connected to the opening/closing guide B 603*b* via the gear 606, so that the guide A 603*a* is rotated in the direction of the arrow 604*b* (see FIG. 6B/FIG. 7B).

When the upper bill mechanism 1*a* is further pushed in, the opening/closing guide A 603*a* is closed and connected to the right transfer guide 605 provided in the upper bill mechanism 1*a*. Then, the opening/closing guide B 603*b* ganged with the opening/closing guide A 603*a* via the gear 606 is also connected to the left transfer guide 605 provided in the upper bill mechanism 1*a*. FIG. 6C and FIG. 7C show how the opening/closing guides A 603*a* and B 603*b* are connected to the right and left transfer guides 605. Because the upper bill mechanism 1*a* is connected to the connecting transfer path such way, loaded bills are transferred along a transfer belt 611.

Figure 6F:
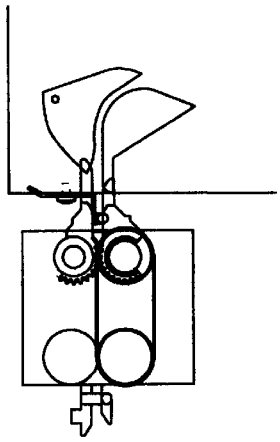
Figure 7A:
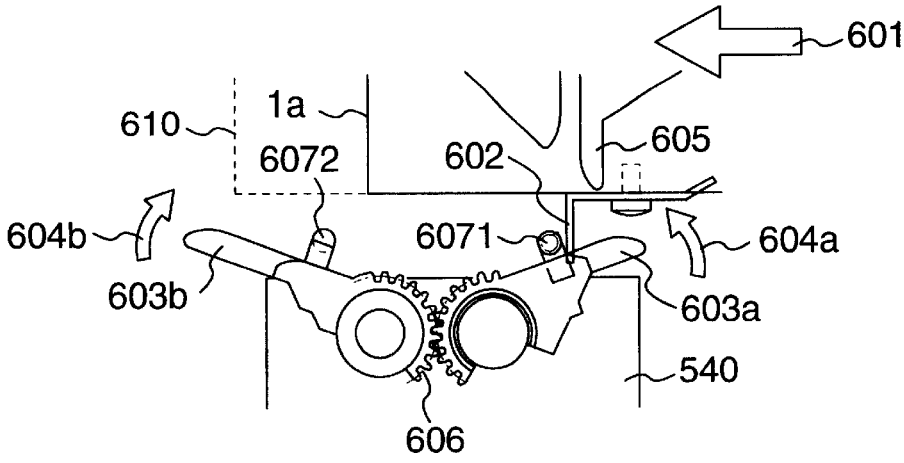
FIGS. 7A to 7C are expanded views for easier understanding of the actions of the first and second projections and the opening/closing guides A and B shown in FIGS. 6A through FIG. 6C.
Figure 7B:
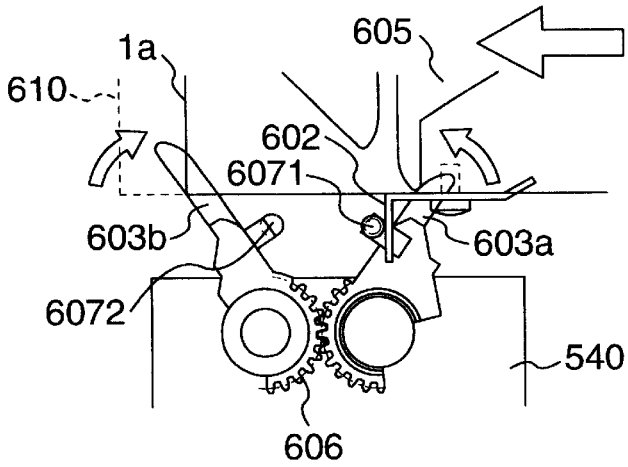
Figure 7C:
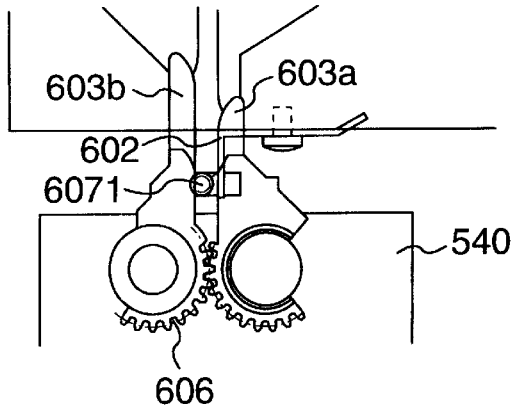

FIG. 6D through FIG. 6F show how the upper bill mechanism 1*a*, which is pulled out to the front side of the machine 101, is pushed into the machine 101 from the front side (front side operation type). The operation states as shown in FIG. 6D through FIG. 6F are the same as those shown in FIG. 6A through FIG. 6C except that the upper bill mechanism 1*a* is pushed into the machine from the front side. The description for the operation states will thus be omitted here. In the case of the operations shown in FIG. 6D through FIG. 6F, the fixing position of the first projection 602 must be changed from that shown in FIG. 6A through FIG. 6C. And, in this case, the second projection 6072 fixed to the opening/closing guide B 603*b* is used as shown in FIG. 6D through FIG. 6F.

While a description is made for pushing the upper bill mechanism 1*a* up to the reference position 610 in the above embodiment, the lower bill mechanism 1*b* can also be pushed up to the reference position 610 in the same way, since a pair of guides to be opened/closed by the springs are also provided at the bottom face of the connecting transfer path (transfer path connecting means) 540.

Furthermore, the upper bill mechanism 1*a* or lower bill mechanism 1*b* pushed up to the reference position 610 in the machine 101 is pulled out from the machine 101 in the order as shown in "FIG. 6C or FIG. 7C"→"FIG. 6B or FIG. 7B"→"FIG. 6A or FIG. 7A" or FIG. 6F→FIG. 6E→FIG. 6D.

As apparent from the above description, when the upper bill mechanism 1*a* or lower bill mechanism 1*b* is pulled out from the machine 101 (from the front side or rear side of the machine 101), no bill is broken and/or the opening/closing guides A 603*a* and B 603*b* are prevented from damages even when a bill remains (jams) around the connecting transfer path (transfer path connecting means) 540, since the opening/closing guides A 603*a* and B 603*b* are pressed so as to open by springs, etc., thereby those guides A and B are opened step by step as the mechanism 1*a*/1*b* is pulled out.

While both of the opening/closing guides A 603*a* and B 603*b* are provided in the above embodiment, so that both of the guides A and B are opened when a unit is pulled out from the machine 101, the present invention is not limited only to that configuration; it is also possible to use only one guide.

Furthermore, while the opening/closing guides A 603*a* and B 603*b* are different from each other in length in the above embodiment, those guides A and B may be equal in length, for example, when the transfer path is not two-way, when none of the transfer guides has a selector gate function, and when there is provided a space enough for enabling the selector gate to rotate. The present invention can apply even to such the case, of course.

Furthermore, when a transfer guide to be engaged with an opening/closing guide A 603*a*/B 603*b* is protruded from the unit, only one of the opening/closing guides A 603*a* and B 603*b* may be opened so as to remove/install the unit. Concretely, the unit is installed while only the longer opening/closing guides A 603*a* is opened and the shorter opening/closing guide B 603*b* is closed. This is because no problem arises from the sliding of the unit even when the shorter opening/closing guide B 603*b* is closed in the case where the transfer guides are protruded from the unit. However, the unit is removed/installed only from the side where the longer opening/closing guide A 603*a* is located, that is, the guide to be opened is located. In this case, the gear used to connect opening/closing guides A and B to each other in the above embodiment may be omissible. And, as described above, when the opening/closing guides A 603*a* and B 603*b* are equal in length, any of the guides A and B may be closed, of course.

According to the present invention, therefore, it is possible to prevent bills from jams around the transfer path connecting means used to connect divided bill transfer means, as well as prevent any of the divided transfer means and guides that are members of the transfer path connecting means from damages when any of the divided transfer means is pulled out from the machine for maintenance.

What is claimed is:

1. A bill handling machine for depositing or/and withdrawing bills, comprising:

a first unit provided with a depositing port for depositing bills;

a second unit provided with a depositing cassette for holding deposited bills; and a bill transfer mechanism for transferring bills deposited from said depositing port into said depositing cassette, wherein:

at least one of said first unit and said second unit is removable; and said bill transfer mechanism includes:

a first transfer mechanism provided inside said removable unit and said first transfer mechanism is provided with a first projection, and a connecting transfer mechanism, the connecting transfer mechanism being connected to said first transfer mechanism when the removable unit is installed and being disconnected from said first transfer mechanism when the removable unit is removed, and said connecting transfer mechanism is provided with a guide engaged with said first transfer mechanism and enabled to guide bills, as well as a second projection located at a place where said guide comes in contact with said first projection, wherein said first projection presses said second projection, thereby allowing said connecting transfer mechanism to be connected to said first transfer mechanism when said removable unit is installed in said machine.

2. The bill handling machine according to claim 1, wherein said guide includes first and second guides connected to each other via a connecting member, and said second projection is located so as to face an outside of an end of at least one of said first and second guides.

3. The bill handling machine according to claim 2, wherein said first projection comes in contact with a second projection located at a guide from which side said removable unit is installed.

4. The bill handling machine according to claim 2, wherein said first and second guides are pressed by elastic members so as to open respectively.

5. The bill handling machine according to claim 1, wherein said guide includes first and second guides connected to each other via a connecting member; and said first guide is longer than said second guide.

6. The bill handling machine according to claim 5, wherein said second projection is located outside said end of said first guide; and said removable unit is removed/installed from said first guide side.

7. The bill handling machine according to claim 5, wherein said first and second guides are pressed by elastic members so as to open respectively.

8. The bill handling machine according to claim 1, further comprising a protective cabinet for housing said first unit, wherein said first unit has said safe in itself and said connecting transfer mechanism is housed in said protective cabinet.

9. A bill handling machine for handling bills, comprising:

an upper unit provided with a depositing port and an upper bill transfer path for transferring deposited bills;

a lower unit provided with a bill stacker for stacking bills and a lower bill transfer path for transferring bills to be stacked in said bill stacker;

a transfer path connecting mechanism for connecting said upper bill transfer path and said lower bill transfer path to each other; and a sliding mechanism for sliding at least one of said upper and lower units, wherein said transfer path connecting mechanism includes a bill guide that is engaged with a bill transfer path of a unit to be slid when said unit to be slid is installed in said machine and disengaged from said bill transfer path when said unit to be slid is removed from said machine.

10. The bill handling machine according to claim 9, wherein engagement of said bill guide is controlled in conjunction with the movement of said unit to be slid.

11. The bill handling machine according to claim 9, wherein said transfer path connecting mechanism includes a first projection;

said guide includes a second projection at a place where said guide comes in contact with said first projection; and said first projection presses said second projection, thereby allowing said guide unit to be engaged with said transfer path connecting mechanism when said unit to be slid is installed in said machine.

12. The bill handling machine according to claim 11, wherein said guide is located at a side from which said unit to be slid is installed in, and removed from said bill transfer path.

13. The bill handling machine according to claim 9, wherein said guide includes first and second guides disposed at both sides of said bill transfer path and said first and second guides are pressed by elastic members so as to open respectively.

14. The bill handling machine according to claim 9, wherein said guide includes first and second guides connected to each other via a connecting member; and said first guide is longer than said second guide.

15. The bill handling machine according to claim 9, further comprising a protective cabinet for housing said lower unit; and wherein said connecting transfer mechanism is housed in said protective cabinet.

16. The bill handling machine according to claim 9, further comprising a protective cabinet for housing said lower unit; and wherein said connecting transfer mechanism is housed in said protective cabinet.

17. A bill handling machine for handling bills, comprising:

an upper unit provided with a bill depositing port and a first transfer mechanism for transferring deposited bills;

a lower unit provided with a bill stacker for stacking bills and a second transfer mechanism for transferring bills to be stacked in said bill stacker;

a sliding mechanism that can slide said upper unit and/or said lower unit; and a transfer path connecting mechanism for connecting said upper and lower bill transfer paths to each other, said mechanism being provided with a bill guide to be opened/closed according to the sliding of said upper unit and/or said lower unit by said sliding mechanism.

18. The bill handling machine according to claim 17, wherein said guide is provided with first and second guides provided at both sides of said bill transfer path, and said first and second guides are pressed by elastic members so as to open respectively.

19. The bill handling machine according to claim 17, wherein said guide is provided with first and second guides connected to each other via a connecting member; and said first guide is longer than said second guide.

20. The bill handling machine according to claim 17, wherein said transfer path connecting mechanism includes a first projection;

said guide includes a second projection at a place where said guide comes in contact with said first projection; and said first projection presses said second projection, thereby allowing said guide unit to be engaged with said transfer path connecting mechanism according to sliding of said upper unit and/or said lower unit for installation thereof in said machine.

21. A new bill handling machine according to claim 20, wherein said guide is located at a side from which said unit to be slid is installed in, and removed from said bill transfer path.

* * * * *